US009220967B2

(12) United States Patent
Kaleel

(10) Patent No.: US 9,220,967 B2
(45) Date of Patent: Dec. 29, 2015

(54) METHOD OF PROVIDING A TENNIS PRACTICE TARGET AND DISPLAY

(71) Applicant: Edward M. Kaleel, Ortonville, MI (US)

(72) Inventor: Edward M. Kaleel, Ortonville, MI (US)

( * ) Notice: Subject to any disclaimer, the term of this patent is extended or adjusted under 35 U.S.C. 154(b) by 71 days.

(21) Appl. No.: 14/155,675

(22) Filed: Jan. 15, 2014

(65) Prior Publication Data

US 2014/0148274 A1 May 29, 2014

Related U.S. Application Data

(62) Division of application No. 12/154,858, filed on May 27, 2008, now abandoned.

(51) Int. Cl.

| | |
|---|---|
| ***A63B 69/38*** | (2006.01) |
| ***A63B 71/06*** | (2006.01) |
| ***F41J 5/052*** | (2006.01) |
| *A63B 63/00* | (2006.01) |
| *A63B 24/00* | (2006.01) |

(52) U.S. Cl.

CPC ..... *A63B 69/38* (2013.01); *A63B 71/0605* (2013.01); *A63B 71/0669* (2013.01); *F41J 5/052* (2013.01); *A63B 63/00* (2013.01); *A63B 63/007* (2013.01); *A63B 2024/004* (2013.01); *A63B 2071/0625* (2013.01); *A63B 2210/50* (2013.01); *A63B 2225/50* (2013.01); *A63B 2243/0083* (2013.01)

(58) Field of Classification Search

CPC ..... A63B 69/38; A63B 71/0669; A63B 71/06

USPC ..... 473/462, 467, 192; 273/371, 372; 377/5

See application file for complete search history.

(56) References Cited

U.S. PATENT DOCUMENTS

| | | | | |
|---|---|---|---|---|
| 3,874,664 | A * | 4/1975 | Faurot et al. | 473/462 |
| 5,419,549 | A * | 5/1995 | Galloway et al. | 473/431 |
| 5,478,077 | A * | 12/1995 | Miyahara | 473/154 |
| 5,553,860 | A * | 9/1996 | Zelikovich | 473/455 |
| 5,566,936 | A * | 10/1996 | Newgarden et al. | 473/475 |
| 5,605,336 | A * | 2/1997 | Gaoiran et al. | 273/445 |
| 5,908,194 | A * | 6/1999 | Schachter et al. | 273/372 |
| 6,551,205 | B1 * | 4/2003 | Koelzer et al. | 473/454 |
| 2002/0109301 | A1 * | 8/2002 | Chou | 273/371 |
| 2002/0117804 | A1 * | 8/2002 | Chou | 273/371 |
| 2005/0032581 | A1 * | 2/2005 | Wagner | 473/173 |
| 2013/0267355 | A1 * | 10/2013 | Cripe et al. | 473/462 |
| 2014/0148274 | A1 * | 5/2014 | Kaleel | 473/462 |

* cited by examiner

*Primary Examiner* — Gene Kim
*Assistant Examiner* — M Chambers
(74) *Attorney, Agent, or Firm* — John R. Benefiel

(57) ABSTRACT

A method for enhancing tennis practice by disposing a freely movable tennis court practice target mat so as to lie horizontally within marked playing areas of a tennis court playing surface, the target mat having a plurality of areas each of which generates a signal when impacted by a descending tennis ball. An upright counter-display is also provide responsive to signals from each target area to numerically display the number of hits to each area. Lights and/or speakers may be included to provide an indication when each target area is impacted.

5 Claims, 2 Drawing Sheets

METHOD OF PROVIDING A TENNIS PRACTICE TARGET AND DISPLAY

CROSS REFERENCE TO RELATED APPLICATIONS

This is a divisional of U.S. Ser. No. 12/154,858 filed May 27, 2008 which claims the benefit of U.S. provisional application No. 60/931,908 filed on May 26, 2007.

BACKGROUND OF THE INVENTION

This invention concerns tennis and more particularly targets for practicing shots on tennis courts.

It has heretofore been proposed to provide detectors for determining if a shot impacts the court within bounds by electronically detecting the point of impact of a tennis ball, as described in U.S. Pat. Nos. 5,342,042; 4,855,711; 3,982,759; 4,092,634 and 4,365,805 for example. Targets have also been devised for recording impacts when a tennis ball strikes the target; as described in U.S. Pat. Nos. 5,908,194; 3,874,664; 6,715,760; 5,419,565 and 4,659,090.

Such tennis court targets and displays have not provided any scoring capability such that practicing using the target are not particularly entertaining and this is lack not particularly conducive to extended practice sessions, nor to engaging in competitive activity during practice with another player.

It is an object of the present invention method for providing a improved novel tennis court target and associated scoring display which provides added interest for practice sessions.

SUMMARY OF THE INVENTION

The above recited object as well as other objects which will be appreciated upon a reading of the following specification and claims are achieved by providing a portable target placeable anywhere on the court surface in a horizontal position, and having multiple areas of progressively smaller size, which are impacted by the ball descending to the court surface numeric displays are also provided each giving the total number of times a given target area is impacted in a practice session. A total score numeric display is also provided as a part of the method based on impacts causing tallying of correspondingly different point values for each area in which the increasing size of the target area has a inverse smaller point value. The counter-display is configured so as to be readily viewable on the court by a player. The total score point numeric display provided, tallying the cumulative points scored in any turn provides a basis for engaging in a contest between two or more players during a practice session.

Thus, the practice sessions are given enhanced entertainment value and allow a game like contest such that longer and more intense practices will likely result.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
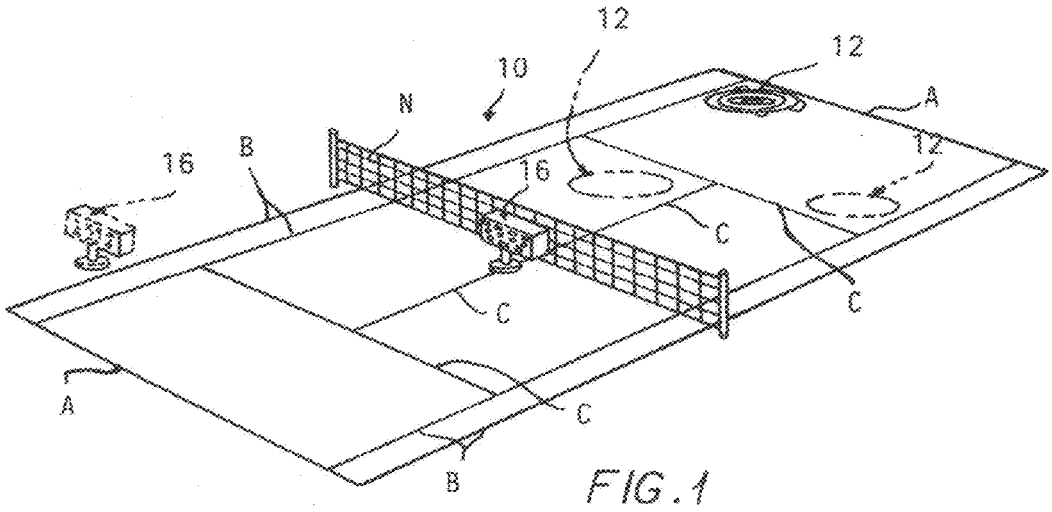
FIG. 1 is a pictorial view of a tennis court having target-display arrangement installed thereon.

Referring to the drawings, FIG. 1 shows a conventional tennis court 10 having a horizontal playing surface marked with conventional baseline, side line and service line markings A,B,C to define the service and backcourt areas. Disposed lying horizontally within a court playing surface marked area, is a multiple area target 12, here taking the form of a bullseye defined by concentric circular areas 14A-14D of progressively greater diameter. The target 12 comprises a portable plastic mat which can be disposed at any desired location lying horizontally within one of the court playing surface areas and is made of weather resistant material such as durable plastic.

A counter-display 16 is pedestal mounted to be able to be supported elevated above the court as at the net or along the sidelines 28A-28D for easy viewing by a player. The counter-display 16 comprises a rectangular case having a front face provided with a series of colored lights and numeric displays 30A-30D which are activated by a tennis ball impacting one of the target areas 14A-14D to provide a visual indication of hitting the target and cumulative numeric display correspondingly to such impacts during a practice session as described below in further detail.

Descending ball impacts on each of the target areas 14A-14D generate electrical signals which are transmitted to the counter-display 16, preferably by a wireless transmitter 18 associated with the target 12, and processed therein by suitable circuitry to activate display lights and numeric displays as described in further detail below. The target would typically include rechargeable batteries 19, terminals, etc. (not shown) as necessary to be powered.

Figure 2:
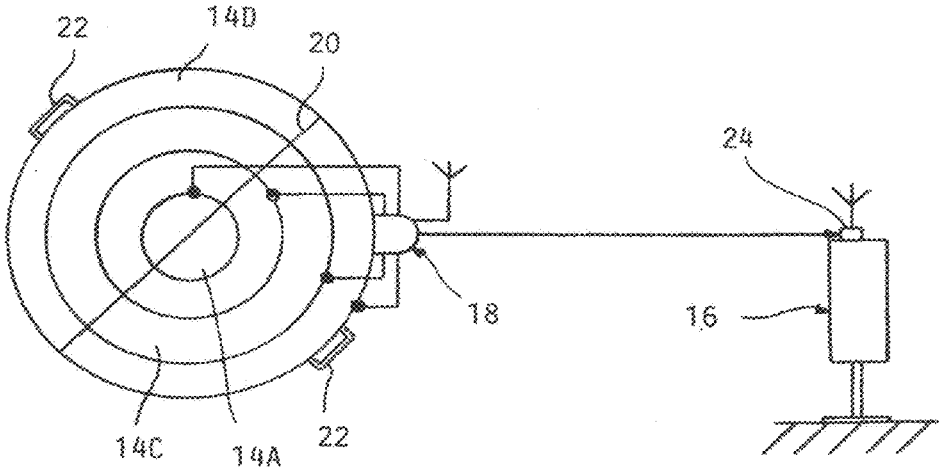
FIG. 2 is a diagrammatic view of the target and counter-display depicting the major features.

Referring to FIG. 2, the target 12 is comprised of areas progressively smaller 14A-14B, each which are individually impact sensitive, i.e., generate an electrical signal when impacted by a descending tennis ball. This can be accomplished by various means known in the art including piezoelectric or other well known impact sensitive panels such as described in U.S. Pat. Nos. 5,394,824; 4,824,107; 4,855,711; 5,908,194 and 3,874,664.

The electrical signals are generated by ball impacts on each of the target areas 14A-14D are transmitted via electrical leads to a wireless transmitter 18, which differentiates the signals from each target area 14A-14D, and transmits a coded signal corresponding to each area 14A-14D to the counter-display 16.

Figure 3:
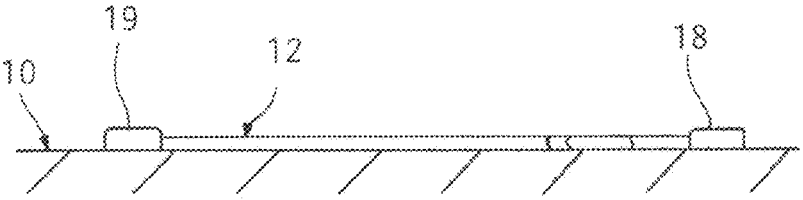
FIG. 3 is an elevational view of the target shown in FIGS. 1 and 2 lying on a court surface.
Figure 4:
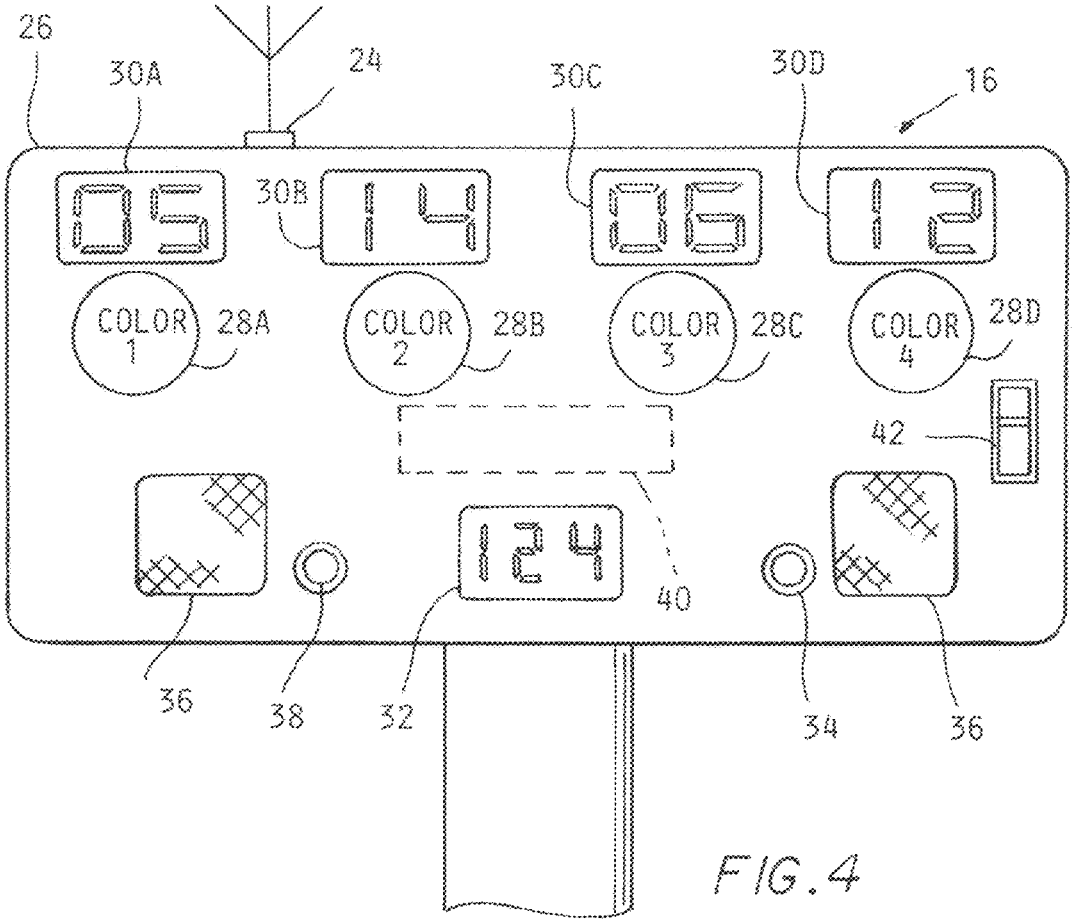
FIG. 4 is an enlarged front view of the counter-display component shown in FIGS. 1 and 2.

The target 12 preferably comprises a weather resistant flexible plastic mat which lies flat on the court surface 10 as seen in FIG. 3, and may be foldable as in half along a fold line 20, bringing perimeter handles 22 together for ease in carrying.

The counter-display 16 includes a wireless receiver element 24 receiving coded signals from the transmitter 18. Such wireless communication devices utilizing various wave energy such as RF, infrared sonic, etc. are well known for this purpose.

The counter-target display 16 may include case 26 mounting at the front corresponding colored lights 28A, B, C, and D matching the coloring of each target area 14A-14D. Each light 28A, B, C, or D is illuminated briefly when a tennis ball impacts the respective target area.

In addition, a respective numeric display 30A, B, C, D is located adjacent each lights 28A-28D which displays the total count of impacts of the corresponding target area 14A-14D in a given session.

A cumulative point total display 32 is provided at the center of the case 26. Different point values may be assigned to the target areas 14A-14D and the point totals summed in a suitable counter-processor 40 contained in the case 26 operating the lights and also speakers 36.

This enables use as a competitive game played by two or more players

A reset button 34 can be used to clear the counter displays 30A-30D and 32.

The speakers 36 can also optionally be provided, which can broadcast particular song excerpts corresponding to each target area 14A-14D when a given area is hit. Such song excerpts or other sounds can be selectively prerecorded in a memory in the case 26, with volume controls 38 also optionally provided.

A switch 42 can be included to switch from sound to lights and vice versa, or to turn off both.

Accordingly, a more entertaining tennis practice target display method is provided which will motivate players to carry out more intensive practice sessions.

The invention claimed is:

1. A method for enhancing tennis practice by providing a target and counter display on a tennis court having two horizontal playing surfaces each with a baseline, side lines and service line markings defining backcourt and service areas, and a net extending between said playing surfaces, the method comprising:

placing a freely movable target mat horizontally on one of said tennis court playing surface areas defined within said markings, said target mat having a plurality of distinct target areas comprised of concentric circular areas which extend horizontally when so placed on said tennis court playing surface, each target mat area generating a respective corresponding electrical output signal when impacted by a tennis ball hit by a practicing player so as to descend into contact therewith; and locating an upright counter-display on another of said playing surfaces of said tennis court on the other side of said net with a vertical numeric display so as to be viewable by the practicing player on said other side; directing target respective electrical output signals to said counter display; generating numeric displays by said counter display, each responsive to signals from a respective distinct target area, and totaling and displaying the number of impacts of a descending ball with each respective target area in a single practice session of said practice player with different point values assigned to impacts with target areas with total points corresponding to said impacts displayed for said practice session and further providing a series of lights each associated with a respective distinct target area and illuminating a respective light in said series each time a ball impacts a corresponding distinct target area when descending onto a court surface.

2. The method arrangement according to claim 1 further including a calculating and displaying numerically the total number of impacts with said plurality of distinct target areas on said counter display.

3. The method according to claim 1 including defining said plurality of distinct target areas by concentric circles to form a bulls eye with several target areas.

4. The method according to claim 1 further including providing sound speakers and generating a distinct sound by said one or more speakers each time an impact of a respective distinct target area occurs.

5. The method according to claim 1 further including wirelessly transmitting said target signals to said counter-display.

* * * * *